US005624278A

United States Patent [19]

Kuroda et al.

[11] Patent Number: 5,624,278

[45] Date of Patent: Apr. 29, 1997

[54] ELECTRIC WIRE CONNECTOR COAXIAL CABLE CONNECTOR AND COAXIAL CONNECTOR APPARATUS

[75] Inventors: Hiroyuki Kuroda; Yasuo Komatsu, both of Hachioji; Kenji Kimura, Tokyo, all of Japan

[73] Assignee: Olympus Optical Co., Ltd., Tokyo, Japan

[21] Appl. No.: 434,405

[22] Filed: May 3, 1995

[30] Foreign Application Priority Data

Jul. 15, 1994 [JP] Japan ..... 6-164207

[51] Int. Cl.[6] ..... H01R 13/514

[52] U.S. Cl. ..... 439/675; 434/63; 434/578; 434/752

[58] Field of Search ..... 439/675, 752, 439/63, 578

[56] References Cited

U.S. PATENT DOCUMENTS

| | | | |
|---|---|---|---|
| 3,292,117 | 12/1966 | Bryant et al. | 439/578 |
| 4,445,745 | 5/1984 | Cartesse . | |
| 5,120,258 | 6/1992 | Carlton | 439/63 |
| 5,167,534 | 12/1992 | Ohsumi | 439/752 |
| 5,237,293 | 8/1993 | Kan et al. | 439/578 |
| 5,403,213 | 4/1995 | Inaba et al. | 439/752 |
| 5,518,334 | 5/1996 | Yagi et al. | 439/752 |

FOREIGN PATENT DOCUMENTS 61-21811 6/1986 Japan .

*Primary Examiner*—Stephen P. Garbe

*Attorney, Agent, or Firm*—Armstrong, Westerman Hattori, McLeland & Naughton

[57] ABSTRACT

An electric wire connector has an insulating member which has a through hole running in the axial direction and a transverse hole provided between exterior and the through hole in a different direction from the axis of the through hole; a contact which is inserted in the through hole and which has a fitting structure in a position matching an inside opening, i.e. the opening on the through hole side of the transverse hole; and a position restricting member which is inserted through an outside opening, i.e. the opening on the outer side of the transverse hole to be fitted in the fitting structure of the contact to restrict the position of the contact.

10 Claims, 11 Drawing Sheets

14
15
13
12
16
25
25a
28
27

5
10
9
8
11
25
24
25a
28
27

5
24
30
29
18
19
28
25a
27
26a
26b
26
26b
26b
31

25a
30
24
27

ELECTRIC WIRE CONNECTOR COAXIAL CABLE CONNECTOR AND COAXIAL CONNECTOR APPARATUS

BACKGROUND OF THE INVENTION

1. Field of the Invention

The present invention relates to an electric wire connector which is attached to an end of a signal cable.

2. Description of the Related Art

One end of a conventional coaxial cable for transmitting a signal, electric power, or the like is provided with a coaxial cable connector to allow the coaxial cable to be connected and disconnected. Such a coaxial cable connector is constructed primarily by an inner conductor, an insulating member disposed around the inner conductor, and an outer conductor disposed around the insulating member. The inner conductor and the outer conductor of the coaxial cable connector are connected to a core and a shielding wire, respectively, of the coaxial cable.

The three members, namely, the inner conductor, the insulating member, and the outer conductor, of the coaxial cable connector must be fixed with sufficient strength in the connecting and disconnecting directions to survive frequent connection and disconnection.

Hence, in the conventional coaxial cable connector, of the three members, i.e. the inner conductor, the insulating member, and the outer conductor, the insulating member and the outer conductor are plastically or elastically deformed by applying external force to secure fixing force, so that all the members are fixed firmly to survive the connection and disconnection.

The coaxial cable connector disclosed in the Publication of Japanese Utility Model No. 61-21811, for example, has the following construction: the inner conductor equipped with a tapered projection, which has a larger diameter than that of a through hole provided along the central axis of the insulating member, is fixed with pressure in the through hole of the elastic insulating member. The internal circumference of the outer conductor is provided with a tapered section and the aforesaid elastic insulating member is held and fixed with pressure onto the tapered section.

The coaxial cable connector, however, is repeatedly subjected to connection and disconnection; therefore, the inner conductor must be firmly fastened with the insulating member or the outer conductor. For this reason, in order to improve the strength of fixing the inner conductor to the insulating member in the connector for coaxial cable disclosed in the Publication of Japanese Utility Model No. 61-21811, it is necessary to make a design change such as increasing the diameter of the tapered projection of the inner conductor and employing a hard material with a large Young's modulus for the insulating member.

In the coaxial cable connector disclosed in the Publication of Japanese Utility Model No. 61-21811, however, the tapered projection stretches the through hole in the insulating member as the inner conductor of the coaxial cable connector is inserted. This structure has a drawback in that the improvement in the fixing strength made by the design change described above is limited and it is difficult to accomplish the fixing strength which is sufficient to survive highly frequent connection and disconnection.

Furthermore, since the tapered projection deforms the through hole in the insulating member when inserting the inner conductor, the insulating member cannot fully restore its shape to fit itself tightly around the contour of the tapered projection unless the insulating member is made of a sufficiently flexible material. Hence, the area of the contact between the tapered projection and the insulating member, which cannot fully restore its original shape, undesirably decreases from a designed value of area, leading to the difficulty of securing adequate fixing strength.

In addition, the inner conductor has a stopper with a large outside diameter and the stopper is applied to the side surface of the insulating member to position it. This, however, makes it difficult to decide whether the inner conductor has fully been press-fitted in the insulating member since an elastic member is used for the insulating member which exhibits low resiliency. Therefore, the stopper sometimes undesirably goes too far into the insulating member, presenting a problem in addition to the difficulty in determining incomplete press-fitting. Thus, the structure presents another shortcoming, that is, the difficult positioning of the inner conductor in relation to the insulating member.

The shortcomings stated above are encountered not only when press-fitting the inner conductor into the insulating member; they are encountered also when press-fitting the insulating member into the outer conductor. The press-fitting is involved in the assembly of the inner conductor and the insulating member and also in the assembly of the insulating member and the outer conductor, leading to a problem in that the assembly of the coaxial cable connector takes much time and labor.

SUMMARY OF THE INVENTION

It is accordingly an object of the present invention to provide an electric wire connector which is capable of fixing, with sufficient strength, a contact such as an inner conductor of a coaxial cable connector to an insulating member disposed around the contact and which permits easier assembly.

It is another object of the present invention to provide a coaxial cable connector, which connector is capable of fixing, with sufficient strength, a contact such as an inner conductor of a coaxial cable connector, to an insulating member disposed around the contact and which permits easier assembly.

It is still another object of the present invention to provide a coaxial connector apparatus which permits easier assembling of a coaxial cable connector onto a board.

To these ends, according to the present invention, there is provided an electric wire connector constituted by an insulating member, which has a tunnel running therethrough in the axial direction and an aperture in a direction transverse to the axial direction, the aperture leading from a cut-out in the outer circumferential surface of the cylindrical insulating member to the tunnel; a contact having a section which is fitted into the tunnel and which is located in a position corresponding to an inside opening, i.e. the opening on the tunnel side of the transverse hole; and a position restricting member which is inserted through the open section of the cut-out and into the aperture to be fitted into the fitting section of the contact so as to restrict the position of the contact.

Other characteristics and advantages of the present invention will become apparent from the following description.

BRIEF DESCRIPTION OF THE DRAWINGS

FIG. 1 through FIG. 3 relate to a first embodiment of the present invention;

FIG. 1 is a perspective view illustrative of the outline of a coaxial cable connector;

FIG. 3 is a cross-sectional view of the transverse hole of the coaxial cable connector;

FIG. 4 through FIG. 6 relate to a second embodiment of the present invention;

FIG. 4 is a perspective view of the coaxial cable connector;

FIG. 6 is a cross-sectional view of the transverse hole of the coaxial cable connector;

FIG. 10 through FIG. 14 relate to a third embodiment of the present invention;

FIG. 10 is an exploded perspective view illustrating a coaxial connector apparatus;

FIG. 12 is a perspective view illustrative of the coaxial cable connector;

FIG. 13 is a perspective view illustrative of the contact which has been connected to the printed circuit board;

FIG. 14 is a perspective view illustrative of the area in the vicinity of the rear panel of an image processing apparatus wherein the coaxial connector apparatus of the third embodiment is applied to electronic equipment;

FIG. 16 and FIG. 17 relate to a fifth embodiment;

FIG. 16 is an exploded perspective view illustrative of the coaxial connector apparatus;

DESCRIPTION OF THE PREFERRED EMBODIMENTS

The first embodiment will be described with reference to FIG. 1 through FIG. 3. In the embodiment to be discussed below, a coaxial cable connector will be used as an example of the electric wire connector.

Figure 1:
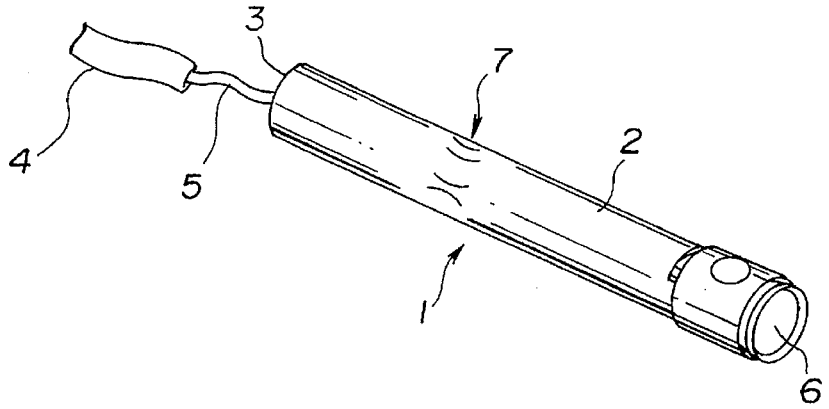

As shown in FIG. 1, a coaxial cable connector 1 has an electrically conductive outer conductor 2 which is cylindrically shaped. Formed on one end surface of the outer conductor 2 is a cable side end section 3. A core 5 of a coaxial cable 4, which is connected to a cable fixing section of the inner conductor to be discussed later, is led out from the cable side end section 3. Provided in the vicinity of the cable side end section 3 is a cable section to which the shielding wire of the coaxial cable, not shown, is connected.

Provided on the other end surface of the outer conductor 2 is a connector opening 6 to be fitted to a coaxial cable connecting adaptor which is not shown.

The outer conductor 2 is provided with a crimped section 7 which is formed by crimping with a jig or the like. The crimped section 7 serves to hold and fix the insulating member which is housed in the outer conductor in a manner to be described later.

Figure 2A:
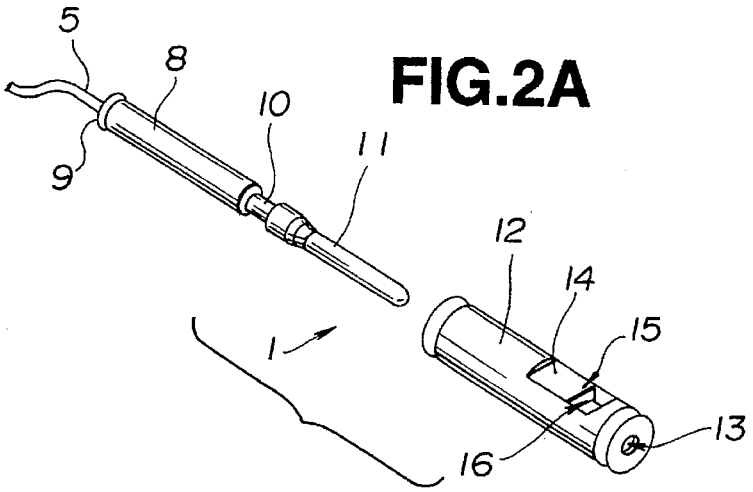
FIG. 2A is a perspective view illustrative of an inner conductor and an insulating member.

As shown in FIG. 2A, the coaxial cable connector 1 has an inner conductor 8 which serves as the contact to which the core 5 of the coaxial cable 4 is connected. The inner conductor 8 is comprised of a cylindrical lengthy electrically conductive material and the core 5 is connected by soldering or crimping to a cable fixing section 9 on one end of the inner conductor 8. The inner conductor 8 further has a groove 10, which provides a fitting section, at the center part thereof. The groove 10 is formed over the entire outer circumference around the axis of the cylindrical inner conductor 8. An electrical contact section 11 is formed on the distal end of the inner conductor 8. The electrical contact section 11 is electrically connected to the central conductor of the coaxial cable connecting adaptor which is not shown.

The coaxial cable connector 1 is provided with a cylindrical insulating member 12, which covers the outer circumference of the inner conductor 8, so as to insulate the outer circumference of the inner conductor 8 structured as stated above. The insulating member 12 is composed of an insulating material such as ethylene tetrafluoride and vinyl chloride which can be easily deformed. The cylindrical insulating member 12 is equipped with a through hole 13 which runs along the central axis thereof.

The tunnel 13 through the cylindrical insulating member 12 slidingly accepts the cylindrical inner conductor 8 so that the electrical contact member 11 at one end of the inner conductor 8 projects out of the tunnel 13. The inside diameter of the tunnel 13 is only slightly larger than the outside diameter of the inner conductor 8 to allow the inner conductor 8 to be inserted into the tunnel 13 with little resistance.

The outer circumferential surface of the insulating member 12 has a cut-out 15 therein, the cut-out having a rectangular surface including a flat section 14 and an open section.

The periphery of the open section of the cut-out 15 coincides with an outer circumference of the aperture 16 and aperture 16 leads from cut-out 15 to tunnel 13. The aperture 16 is formed so that it orthogonally intersects with the tunnel 13 provided along the central axis of the insulating member 12 and the aperture 16 and the tunnel 13 intersect at an inner circumference.

Figure 2B:
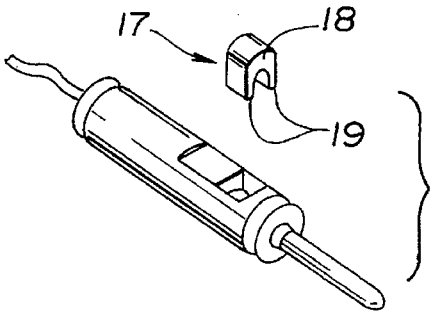
FIG. 2B is a perspective view illustrative of a semi-finished assembly of the inner conductor and the insulating member, and a position restricting member.

As shown in FIG. 2B, a position restricting member 17 is inserted in the aperture 16. The position restricting member 17, which is inserted through the open section of cut-out 15 and into the aperture 16, has an approximately identical configuration to that of the outside opening of the aperture 16 when it is observed from above. The position restricting member 17 is formed into a horseshoe having a horseshoe-shaped surface 18 when it is observed from the front. The inside dimension of a forked section 19 formed on the horseshoe-shaped surface 18 is approximately the same as the outside diameter of the groove 10 formed in the inner conductor 8 which is inserted in the tunnel 13 of the insulating member 12. Likewise, the depth of the position restricting member 17 is approximately identical to the dimension of the groove 10, so that the position restricting member 17 can be fitted in the groove 10 when the inner conductor 8 is inserted into the insulating member 12.

For the position restricting member 17, as in the case of the insulating member 12, an insulating material such as a polymer of ethylene fluoride including ethylene tetrafluoride and vinylidene fluoride, or an ethylene polymer substituted by chlorine represented by vinyl chloride, or a copolymer of these may be used. In addition to the resins commonly used as the insulating material for an electric wire connector, a polymeric resin such as acrylic resin and rubber, or a silicon-based polymeric resin such as silicone rubber may be used. Furthermore, an oxide-based or nitride-based insulating ceramic such as alumina, quartz glass, and silicon nitride may also be used.

Figure 2C:
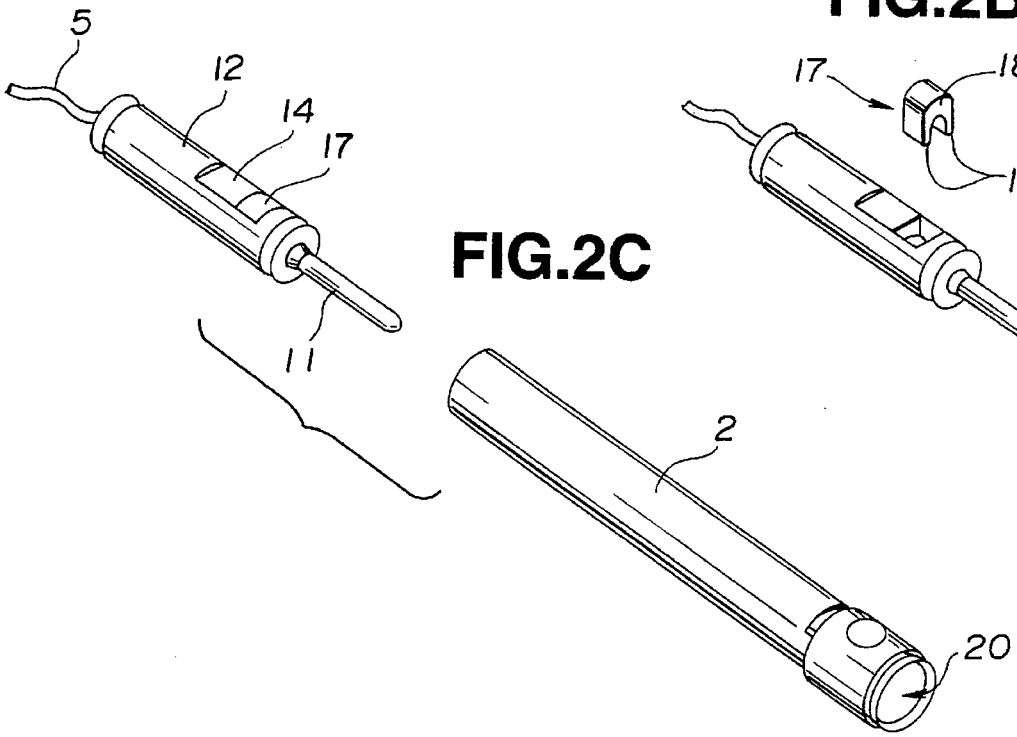
FIG. 2C is a perspective view illustrative of a semi-finished assembly with the position restricting member fitted, and an outer conductor.

The outer conductor 2 is fitted on the outer circumference of the insulating member 12 to form the coaxial cable connector 1. As illustrated in FIG. 2C, the outer conductor 2 is composed of an electrically conductive metal cylinder. A hollow section 20 of the cylindrical outer conductor 2 is formed to have the inside diameter which is nearly identical to the outer diameter of the insulating member 12 so as to permit easy insertion of the insulating member 12.

The configuration of the outer conductor 2, which is composed of electrically conductive metal, can be changed by a jig. Thus, as shown in FIG. 2C and FIG. 1, the insulating member 12 is inserted into the hollow section 20 of the outer conductor 2 and the outer conductor 2 is crimped by a jig or the like, thereby allowing the insulating member 12 to be held in and fixed to the outer conductor 2 by the crimped section 7. The outer circumference of the outer conductor 2 may be provided with an insulating member for electrical insulation as necessary.

The following describes the assembling procedure for the coaxial cable connector 1 constructed by the inner conductor 8, the insulating member 12, the position restricting member 17, and the outer conductor 2.

First, as shown in FIG. 2A the inner conductor 8, which has the core 5 of the coaxial cable 4 connected to one end thereof, is inserted from the rear end of the tunnel 13 formed in the insulating member 12. The inner conductor 8, which has been inserted in the insulating member 12, is positioned so that the groove 10 of the inner conductor 8 is fully seen through the outer circumference of aperture 16 of the open section of the cut-out 15 which is formed in the insulating member 12.

After placing the inner conductor 8 in the position which allows the groove 10 to be seen through the transverse hole 15, the position restricting member 17 is inserted through the open section of the cutout 15 and into the aperture 16 as illustrated in FIG. 2B to fit the forked section 19 of the position restricting member 17 in the groove 10 of the inner conductor 8.

At this time, since the depth of the position restricting member 17 is almost the same as the dimension of the open section of cutout 15 in the axial direction of the insulating member 12, the surface constituting the horseshoe-shaped surface 18 of the position restricting member 17 is brought in contact with the side surface of the insulating member 12 which is perpendicular to the central axis of the tunnel 13. As a result, the inner conductor 8 and the insulating member 12 are fastened to each other via the position restricting member 17.

Then, as illustrated in FIG. 2C, the semi-finished assembly, which is composed of the inner conductor 8 and the insulating member 12 fastened into one piece by the position restricting member 17, is inserted in the hollow section 20 formed in the cylindrical outer conductor 2 from the rear end thereof. The inner circumferential surface at the distal end of the hollow section 20 of the outer conductor 2 is provided with a contacting section for restricting the position of the insulating member 12 when it is inserted. Hence, the insulating member 12 inserted from the rear end of the hollow section 20 formed in the outer conductor 2 comes in contact with the contacting section and it cannot go any further as soon as the electrical contact section 11 is located in a desired position.

The outer circumferential section of the outer conductor 2, which corresponds to the area near the rear end of the inserted insulating member 12, is deformed by a crimping jig. As shown in FIG. 1, the crimped section 7 thus formed fixes the insulating member 12 in the outer conductor 2. At this time, the position restricting member 17, which has been inserted through the open section of the cutout 15, is covered by the outer conductor 2, thus preventing the position restricting member 17 from slipping off the insulating member 12. This state is shown in FIG. 3.

Figure 3:
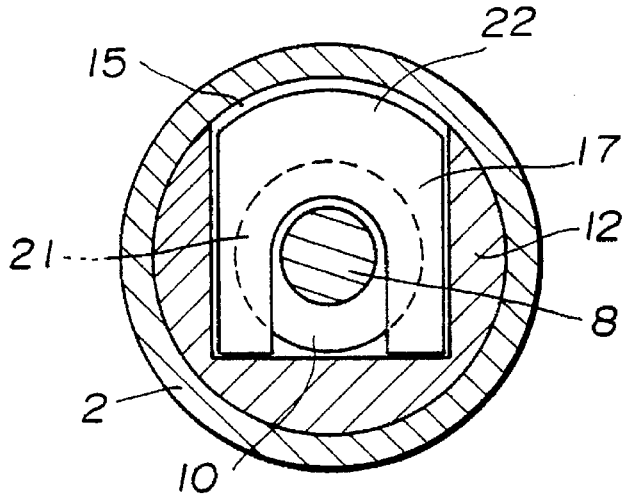

As illustrated in FIG. 3, the position restricting member 17 inserted through the open section of the cutout 15 formed in the insulating member 12 fits, without being deformed, in the groove 10 which is formed in the inner conductor 8, thereby fixing the inner conductor 8 by means of a sufficiently large contacting surface 21 of the side wall of the groove 10, which surface is indicated by the dashed line. A top section 22 of the position restricting member 17 is covered by the outer conductor 2, so that it does not come off through the open section of the cutout 15 of the insulating member 12. Hence, the inner conductor 8 is always fixed in a predetermined position in relation to the insulating member 12.

Thus, in the coaxial cable connector which is the electric wire connector of the embodiment, the position restricting member inserted in the transverse hole formed in the insulating member is fitted in the groove formed in the inner conductor inserted in the tunnel in the insulating member so as to fix the inner conductor and the insulating member. This makes it possible to fix the inner conductor and the insulating member without causing the deformation of the insulating member or the horseshoe-shaped surface of the position restricting member; therefore, a sufficiently large area of the contact between the position restricting member and the groove can be obtained, thus securing the contact area of the designed value. This makes it possible to increase the fixing strength of the inner conductor and the insulating member.

Further, since the position restricting member need not be deformed, it is possible to use, as the insulating material, acrylic resin, insulating ceramic, or other hard material which is hardly elastic. The fixing strength of the inner conductor and the insulating member can be further enhanced by employing such a hard material.

Moreover, the inner conductor can be positioned and fixed in relation to the insulating member simply by inserting the position restricting member with the groove formed in the inner conductor located in the transverse hole in the insulating member. This permits accurate positioning of the inner conductor when inserting it.

The second embodiment of the present invention will now be described in conjunction with FIG. 4 through FIG. 6. The same members as those of the first embodiment will be given the same reference numerals and the explanation thereof will be omitted.

Figure 4:
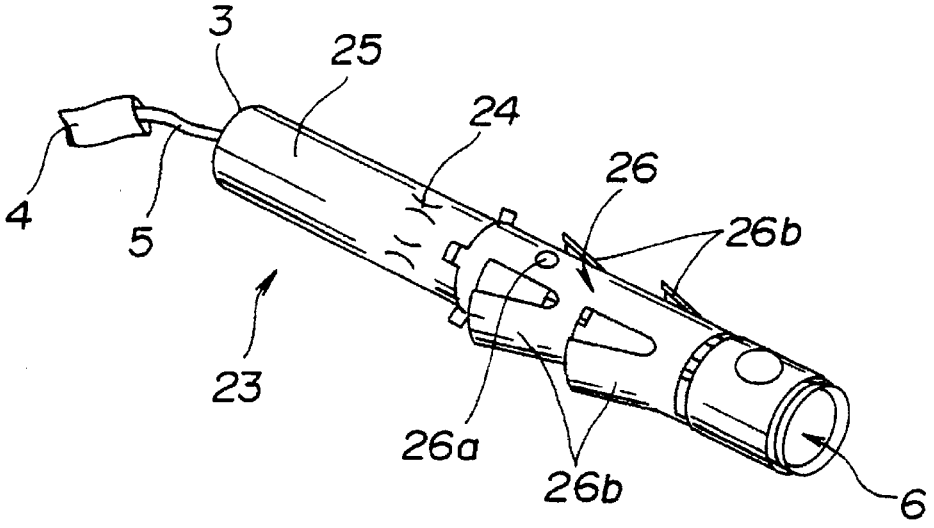

As shown in FIG. 4, a coaxial cable connector 23 according to the second embodiment is constructed by a cylindrical outer conductor 25, on which a crimped section 24 is formed, and a covering member 26 into which the outer conductor 25 is inserted. The covering member 26 has a positioning projection 26*a* which is formed on the outer circumferential surface of the covering member 26 by pressing or the like so that it juts out toward the hollow section. Just as in the case of the first embodiment, the outer conductor 25 has the cable side end section 3 and the connector opening 6.

Figures 5A, 5B, 5C, 5D:
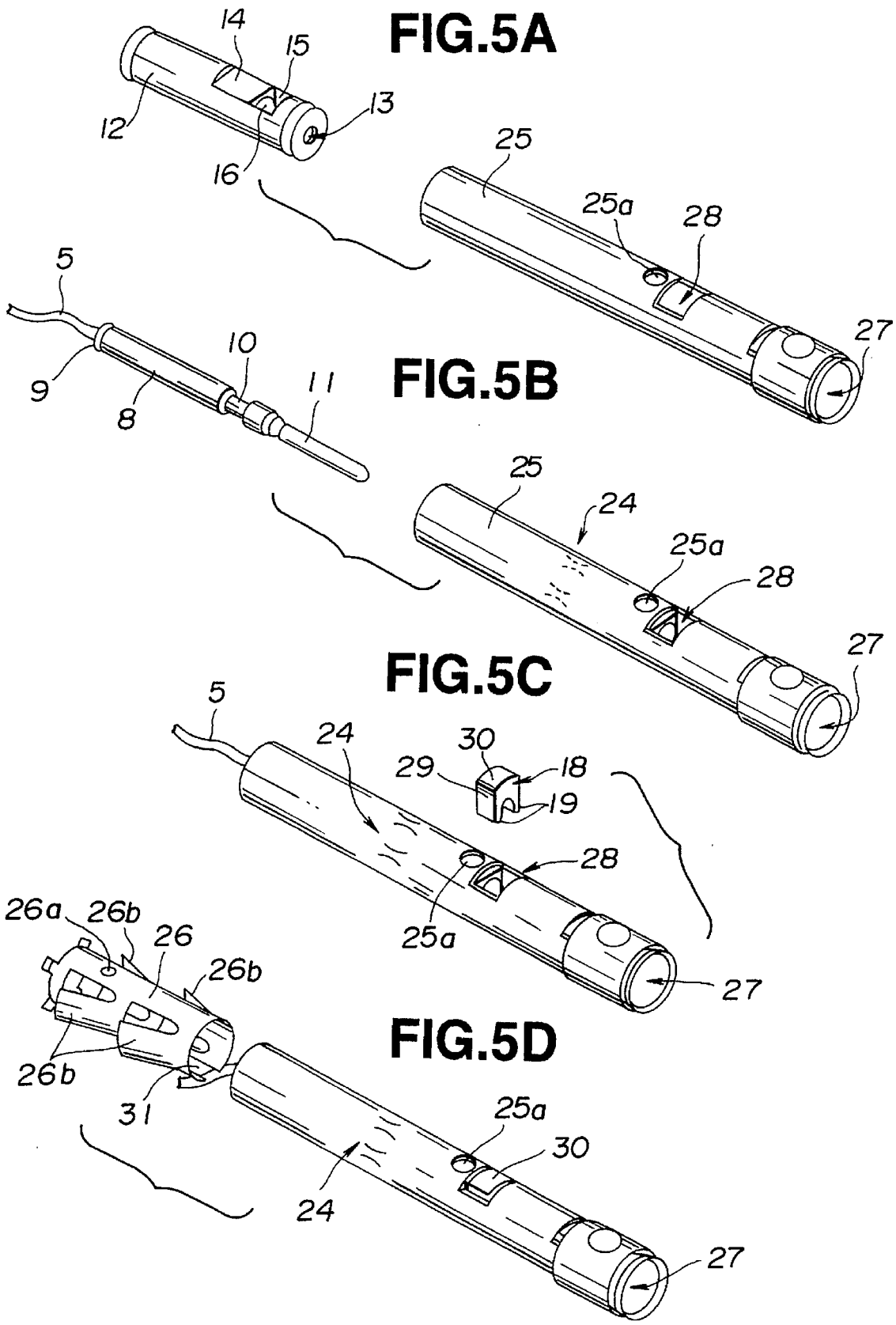
FIG. 5A is a perspective view illustrative of the insulating member and the outer conductor.
FIG. 5B is a perspective view illustrative of a semi-finished assembly of the insulating member and the outer conductor, and the inner conductor.
FIG. 5C is a perspective view illustrative of a semi-finished assembly with the inner conductor fitted, and a position restricting member.
FIG. 5D is a perspective view illustrative of a semi-finished assembly with the position restricting member fitted, and a covering member.
Figure 6:
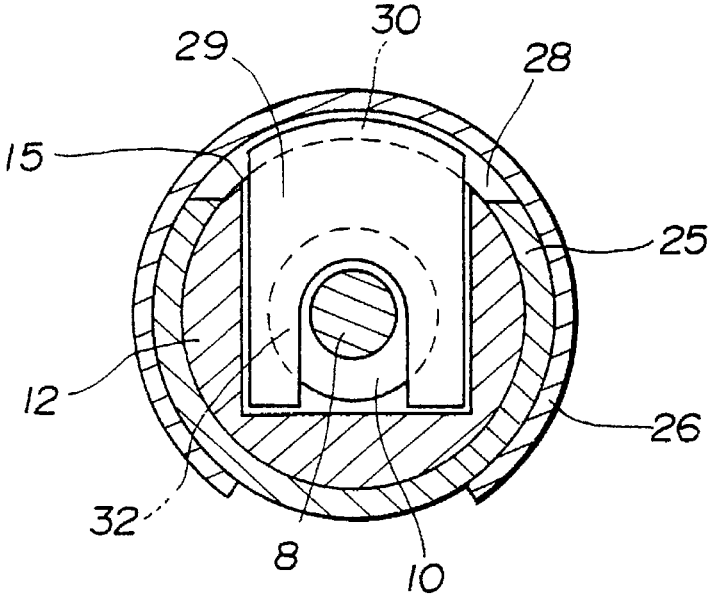

As shown in FIG. 5A and FIG. 5B, the inner conductor 8 and the insulating member 12, which constitute the coaxial cable connector 23, are constructed in the same manner as in the first embodiment described above except the following point: while the flat section 14 in the first embodiment is provided to form a part of the cutout 15, the flat section in the second embodiment serves to provide a space for housing the distal end of the positioning projection 26*a*, which passes through a positioning hole in the outer conductor to be discussed later, in addition to serving to form the cutout 15.

As shown in FIG. 5A, the outer conductor 25, which has a hollow section 27 into which the insulating member 12 is inserted, is composed of a cylindrical metal part, the side surface of the outer conductor 25 having a window 28. The window 28 is provided in a position where the aperture 16 in the cutout 15 formed in the insulating member 12 is exposed when the insulating member 12 is inserted in the hollow section 27. Specifically, a position restricting member 29 can be inserted in the cutout 15 of the insulating member 12 via the window 28 formed in the outer conductor 25.

A positioning hole 25*a* is formed on the rear side of the window 28. The positioning hole 25*a* is provided so that the positioning projection 26*a* formed on the covering member 26 is fitted in the hole 25*a*. More specifically, when the outer conductor 25 is inserted in the covering member 26 to cover the window 28, the outer conductor 25 can be positioned in relation to the covering member 26 by fitting the positioning projection 26*a* in the positioning hole 25*a*.

On the rear side of the outer conductor 25, a coaxial cable shielding wire, which is not shown, is connected by soldering or the like.

As shown in FIG. 5C, the shape of the position restricting member 29 which is inserted through the window 28 of the outer conductor 25 is approximately the same as that of the position restricting member 17 in the first embodiment. The positioning restricting member 29 is formed so that a top section 30 of thereof becomes nearly flush with the outer circumferential surface of the outer conductor 25 when the position restricting member 29 is fitted in the groove 10 formed in the inner conductor 8.

As shown in FIG. 5D, the coaxial cable connector 23 of this embodiment has the covering member 26 which covers the outer circumference of the outer conductor 25. Therefore, the covering member 26 is composed of a hollow, cylindrical, elastic member such as a metallic hollow cylinder which has a hollow section into which the outer conductor 25 is inserted and it has a slit 31 lengthwise. The slit 31 can be spread outward to allow the covering member 26 to be fitted onto the outer conductor 25.

The outer circumference of the covering member 26 is provided with a plurality of vane-shaped projections 26*b* which make it possible to easily and securely mount the coaxial cable connector 23, which is composed of the outer conductor 25 covered with the covering member 26, on a housing member which is not shown.

As stated above, the covering member 26 has the positioning projection 26*a* which is formed on the outer circumferential surface of the covering member 26 by pressing or the like so that it juts out toward the hollow section of the covering member 26.

The assembling procedure for the coaxial cable connector constructed as described above will now be described with reference to FIG. 5A through FIG. 5D.

First, as shown in FIG. 5A, the insulating member 12 is inserted in the outer conductor 25 and it is positioned so that the aperture 16 of the cutout 15 in the insulating member 12 coincides with the window 28 of the outer conductor 25. Then, the outer circumferential section of the outer conductor 25, which corresponds to the rear end section of the insulating member 12, is deformed using a jig or the like to form the crimped section 24. Thus, the insulating member 12 is fixed to the outer conductor 25.

Then, as shown in FIG. 5B, the inner conductor 8 with the core 5 of the coaxial cable 4 attached to one end thereof is inserted in the insulating member 12 which has been fixed to the outer conductor 25 until the groove 10 of the inner conductor 8 is fully exposed through the window 28 of the outer conductor 25 and the cutout 15 of the insulating member 12.

When the full exposure of the groove 10 of the inner conductor 8 has been confirmed through the window 28 and the cutout 15 of the insulating member 12, the position restricting member 29 is inserted through the window 28 to fit the forked section 19 in the groove 10 of the inner conductor 8 as shown in FIG. 5C. Since the shape of the position restricting member 29 is made approximately the same as that of the opening in the cutout 15, the position restricting member 29 contacts depthwise the side surface of the cutout 15. As a result, the insulating member 12 and the inner conductor 8 are fixed via the position restricting member 29.

In the next step, the covering member 26 is fitted onto the outer conductor 25 as illustrated in FIG. 5D so that the positioning projection 26*a* formed on the covering member 26 fits in the positioning hole 25*a* of the outer conductor 25 to place the distal end of the positioning projection 26*a* in the space formed by the flat section 14. At this time, as shown in FIG. 6, the position restricting member 29, which has been inserted in the cutout 15 of the insulating member 12 through the window 28 of the outer conductor 25 of the coaxial cable connector 23, is fitted in the groove 10 of the inner conductor 8 without being deformed. Thus, the inner conductor 8 is fixed by means of a sufficiently large contacting surface 32 of the side wall of the groove 10, the contacting surface being indicated by the dashed line. Further, the covering member 26 covers the window 28, through which the position restricting member 29 has been inserted, so as to bring the top section 30 of the position restricting member 29 in contact with the covering member 26, thereby preventing the position restricting member 29 from slipping off the outer conductor 25.

Thus, this embodiment eliminates the need for inserting the inner conductor in the insulating member beforehand; therefore, the insulating member can be inserted in the outer conductor without the core of the coaxial cable, leading to easier assembly.

The covering member is not limited to the structure stated above; it may be any member as long as it is capable of preventing the position restricting member from coming off. The covering member, therefore, may be composed of an elastic material such as rubber in place of the metallic material. Other operations and advantages are the same as those of the first embodiment.

Figure 7:
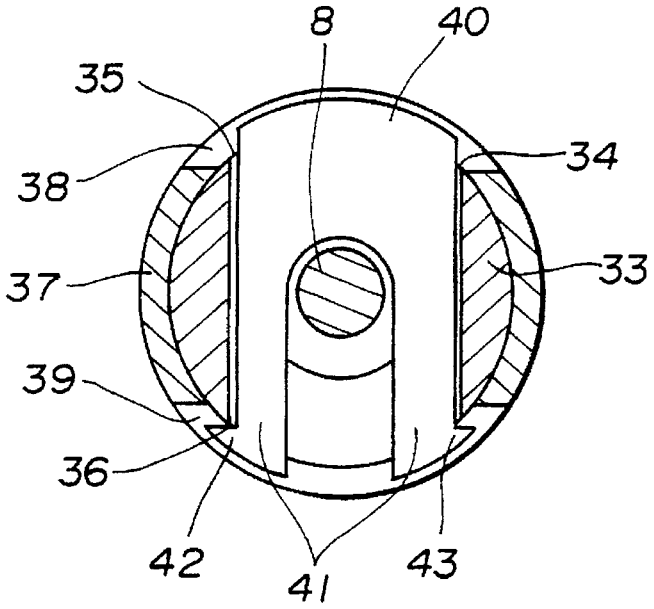
FIG. 7 is a longitudinal side view of the coaxial cable connector which shows a fitted modification of the position restricting member according to the present invention.

Referring to FIG. 7, a modification of the position restricting member 29 in the second embodiment will be described.

The transverse hole 34 formed in the insulating member 33 intersects with the tunnel, through which the inner conductor 8 is inserted, and runs through the insulating member 33. Hence, the outer circumferential surface of the insulating member 33 has a first outside opening 35 and a second outside opening 36. The outer conductor 37 covering the insulating member 33 is provided with a first outer window 38 and a second outer window 39 so that the first outside opening 35 and the second outside opening 36 are exposed when the insulating member is inserted. The distal ends of a forked section 41 of a position restricting member 40 for restricting the position of the inner conductor 8 in relation to the insulating member 33 is provided with a projected section 42 and a projected section 43.

To assemble these members, the insulating member 33 and the inner conductor 8 are first inserted in the outer conductor 37. Then, the position restricting member 40 is inserted through the first outer window 38 of the outer conductor 37 to fit it to the inner conductor 8 and to hook the projected section 42 and the projected section 43 thereof in the second outside opening 36 of the insulating member 33. The projected section 42 and the projected section 43 of the position restricting member 40 are hooked in the second outside opening 36 to independently fix them to the insulating member 33.

This structure eliminates the need for the member corresponding to the covering member 26 which is provided to cover the position restricting member 29 to prevent the position restricting member 40 from dropping off, thus achieving such advantages as fewer members, reduced cost, and labor saving in the assembly.

The position restriction by means of the position restricting member 17 shown in the first embodiment can be applied also to a single-core electric wire connector which is different from the coaxial cable connector. In this case, however, a separate means for preventing the position restricting member 17 from coming off is required because the single-core electric wire connector does not have the outer conductor 2. The use of the position restricting member 40 according to this modification eliminates the need of the means for preventing the position restricting member itself from dropping off.

Another modification of the position restricting member 29 in the second embodiment will be described with reference to FIG. 8.

Figure 8:
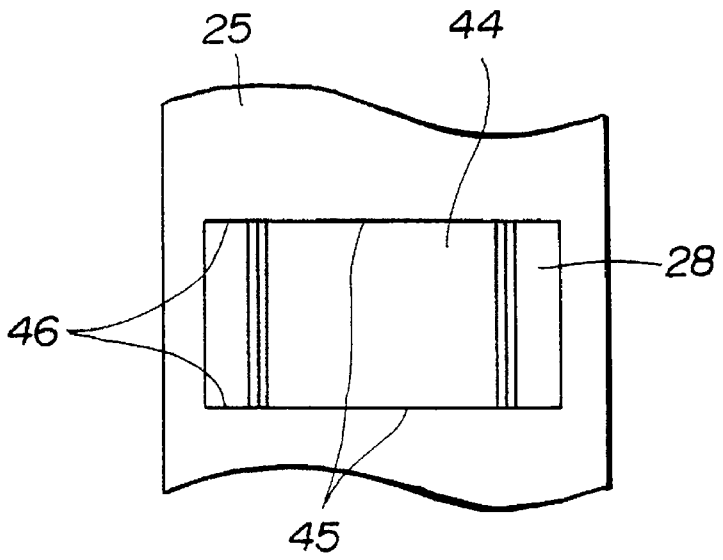
FIG. 8 is a side view of the coaxial cable connector which shows another fitted modification of the position restricting member according to the present invention.

FIG. 8 shows the window 28 viewed from above, the position restricting member 44 having been inserted in the window 28 of the outer conductor 25. The covering member 26 in the second embodiment is not shown. The top section of the position restricting member 44 of this embodiment is provided with a shoulder 45 which is formed to have approximately the same dimension as that of the inside dimension of a window side surface 46 so that the position restricting member 44 contacts the window side surface 46 formed on the window 28 of the outer conductor 25 in the second embodiment. In other words, the shoulder 45 fits in the window 28 when the position restricting member is inserted.

The structure stated above further enhances the fixing strength of the inner conductor 8 and the insulating member 12 in the axial direction and it also allows the inner conductor 8 and the insulating member 12 to be fixed to the outer conductor 25 simply by inserting the position restricting member 44. This makes it possible to omit the step for fixing the outer conductor 25 to the insulating member 12 by crimping or the like.

Owing to the omission of the fixing step such as crimping, the insulating member 12 no longer has to use a deformable member; it may use the aforesaid acrylic resin, insulating ceramic, or other material which is hardly flexible. Hence, the fixing strength in the axial direction can be further enhanced by achieving the structure wherein the insulating member 12 and the position restricting member 44 contact with each other without being elastically deformed.

Figure 9:
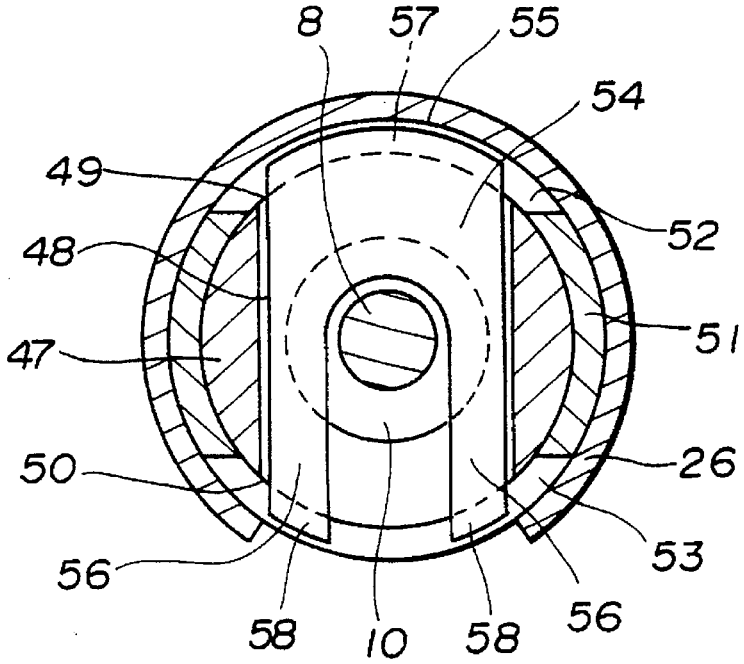
FIG. 9 is a longitudinal side view of the coaxial cable connector which shows still another fitted modification of the position restricting member according to the present invention.

Further, as shown in FIG. 9, a second outer window 53 may be added to the outer conductor 25 to form an outer conductor 51. The position restricting member 44 may be modified to be a position restricting member 54 wherein the distal end sections of the forked section are fitted in the second outer window 53 of the outer conductor 51. A transverse hole 48 of an insulating member 47 is provided to intersect with the tunnel through which the inner conductor 8 is inserted. Specifically, the outer circumferential surface of the insulating member 47 having the transverse hole 48 is provided with a first outside opening 49 and a second outside opening 50. The outer conductor 51 is provided with a outer window 52 and the second outer window 53 to expose the first outside opening 49 and the second outside opening 50 when the insulating member 47 is inserted.

In order to restrict the position of the inner conductor 8 in relation to the insulating member 47, a top section 55 and a forked section 56 of the position restricting member 54 are provided with a first shoulder 57 and a second shoulder 58 which have approximately the same dimension as the inside dimension of the outer window side surface so that the position restricting member 54 contacts the side surfaces of the first outer window 52 and the second outer window 53 of the outer conductor 51. In other words, the shoulders 57 and 58 fit in the first outer window 52 and the second outer window 53 when the position restricting member 54 is inserted.

The position restricting member 54 thus constructed is capable of supporting the outer conductor 51 by fitting it at the top section 55 and the two distal ends of the forked section 56 of the position restricting member 54 around the inner conductor 8. Accordingly, the inner conductor 8 and the outer conductor 51 can be fixed even more firmly than in the cantilever type position restricting member 44 shown in FIG. 8.

Furthermore, providing the distal ends of the forked section 56 of the position restricting member 54 with projections to hook them in the second outside opening 50 eliminates the need of the covering member 26 to prevent the position restricting member 54 from dropping off. This provides the advantages including fewer members, reduced cost, and labor saving in the assembly work as in the modification shown in FIG. 7.

Moreover, in the first and second embodiments, the fitting structure of the inner conductor 8 is the groove 10 provided fully around the outer circumferential surface of the inner conductor 8. The groove, however, may be provided in just a part of the outer circumference and the position restricting member 17 or the like shaped to fit in the groove may be inserted through the cutout 15 or similar to restrict the position.

The third embodiment of the present invention will now be described with reference to FIG. 10 through FIG. 14.

Figure 10:
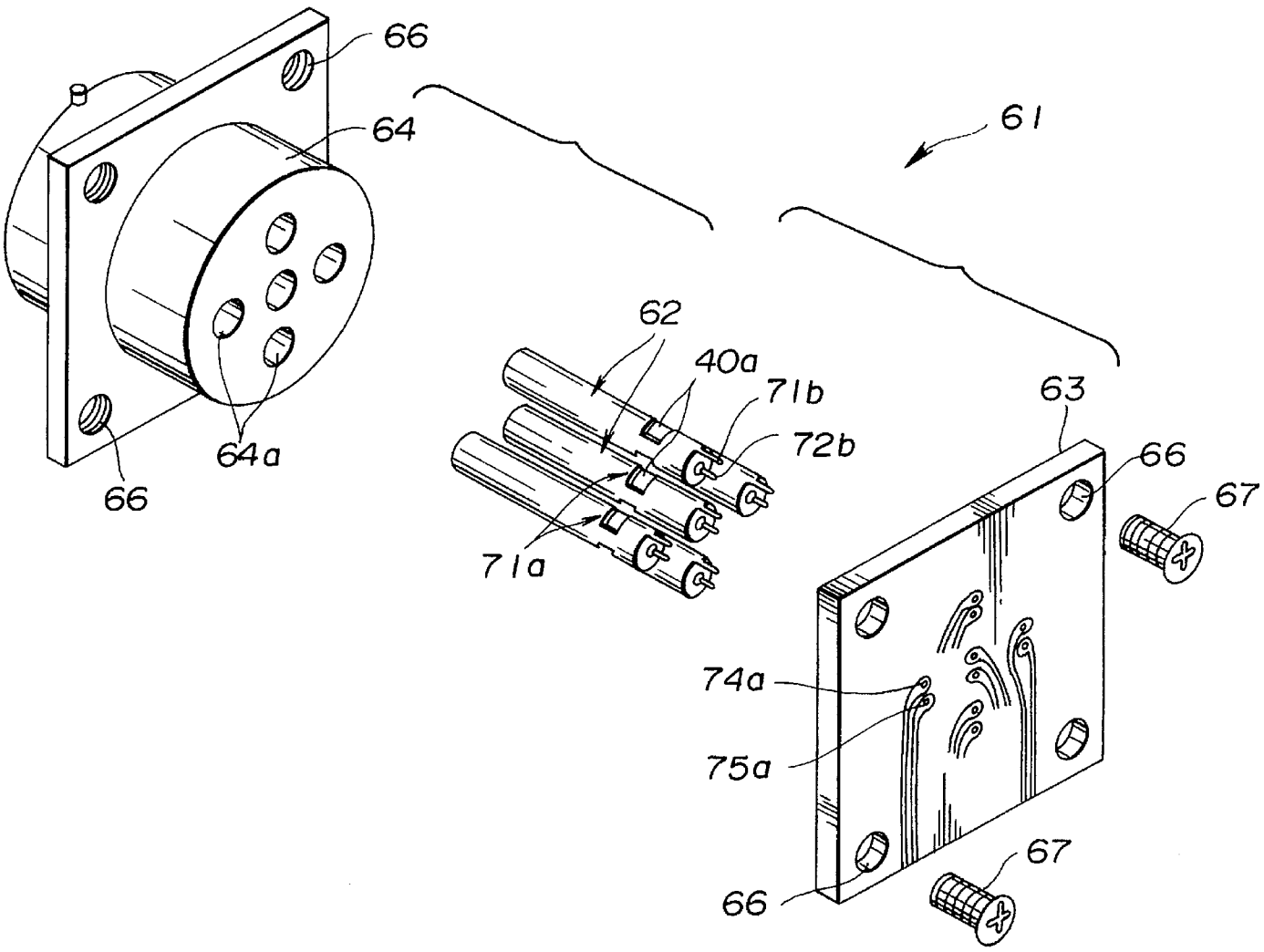

As shown in FIG. 10, a coaxial connector apparatus 61 of the third embodiment is a female coaxial connector apparatus. The coaxial connector apparatus 61 is constructed by a plurality of coaxial cable connectors (hereinafter referred to as "connectors") 62, 62, . . . , a flat printed circuit board 63 to which the proximal ends of the plurality of connectors 62, 62, . . . are attached, and a shell 64 which have holes 64*a*, 64*a*, . . . for maintaining the insulation among the plurality of connectors 62, 62, . . . and which is provided with a connecting section on the front side to which a male connector is attached.

The printed circuit board 63 and the shell 64 are provided with tapped mounting holes 66 at four corners, for example, so that they can be fixed, with screws 67, on a rear panel 131 or the like shown in FIG. 14 to be discussed later. FIG. 11 shows the connectors 62 and the printed circuit board 63 to which the connectors 62 are attached and fixed. For the purpose of simplicity, FIG. 11 shows the section wherein only one connecting connector 62 is attached to the printed circuit board 63.

Figures 11A, 11B, 11C:
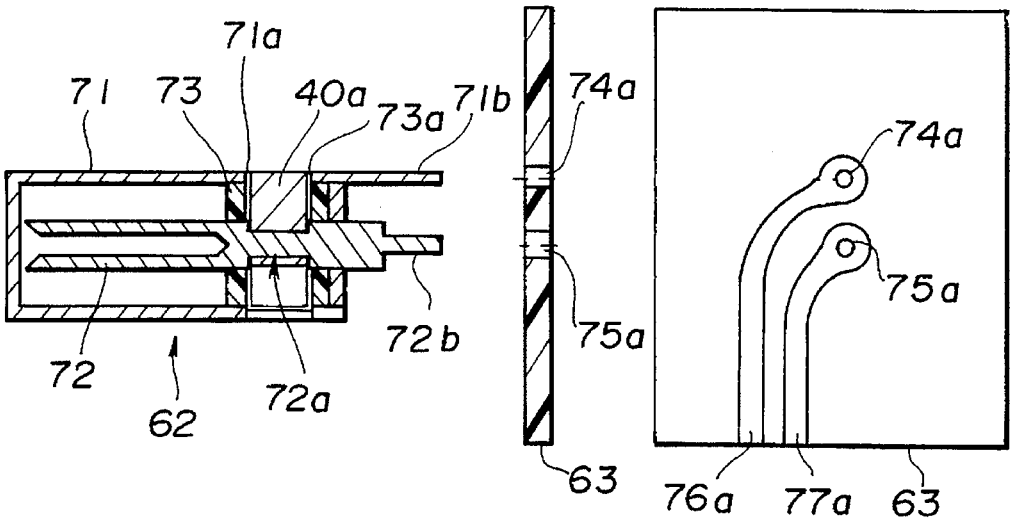
FIG. 11A is a cross-sectional view illustrating the structure of the coaxial cable connector.
FIG. 11B is a cross-sectional view of a printed circuit board.
FIG. 11C shows the printed circuit board viewed from the back.

As show in FIG. 11A, the connector 62 is constructed by a cylindrical connector member 71 which serves as the outer conductor which has a window 71*a* composed of an electrically conductive member such as metal, a rod-shaped connector member 72 which serves as the inner conductor having a groove 72*a* which is disposed near the central axis of the cylindrical connector member 71 and which is the fitting structure and composed of an electrically conductive member such as metal, an insulator 73 serving as the insulating member having a tunnel 73*a* which is disposed between the cylindrical connector member 71 and the rod-shaped connector member 72 to maintain the insulation between the two connector members 71 and 72, and a horseshoe-shaped position restricting member 40*a* which is inserted in the tunnel 73*a* of the insulator 73 and which has almost the same construction as that shown in FIG. 7.

This embodiment employs the female connectors and therefore, the distal end of the rod-shaped connector member 72, which forms the male connector, is provided with a recessed section for press fitting the distal end of the rod-shaped connector member 72. Press fitting makes the two rod-shaped connector members to conduct with each other.

The distal end of the cylindrical connector member 71 which forms the male connecting connector is press-fitted to the distal end of the cylindrical connector member 71, thereby causing the two cylindrical connector members to conduct with each other, thus shielding the rod-shaped connector member disposed inside.

The drawing indicates the structure of the female connector; however, it is also possible to construct a connector apparatus which has the structure of the male connector.

Figure 12:
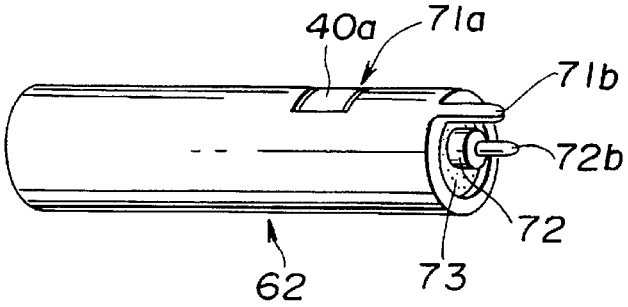

As shown in FIG. 12, the proximal ends of the cylindrical connector member 71 and the rod-shaped connector member 72 are respectively made integral with, for example, lug sections 71*b* and 72*b*. As illustrated in FIG. 11B, the lug sections 71*b* and 72*b* are respectively inserted in tunnels 74*a* and 75*a*, which are the connecting holes provided in the printed circuit board 63, then connected and fixed with solder 78 or the like.

As shown in FIG. 11C, the tunnels 74*a* and 75*a* have adequate diameters to allow the lug sections 71*b* and 72*b* to pass through. The tunnels 74*a* and 75*a* are connected to the lands of strip lines 76*a* and 77*a* formed on the printed circuit board 63, the other ends of the strip lines 76*a* and 77*a* extending, for example, downward to be connected to a flat cable 121 shown in FIG. 14 which will be discussed later.

Figure 11D:
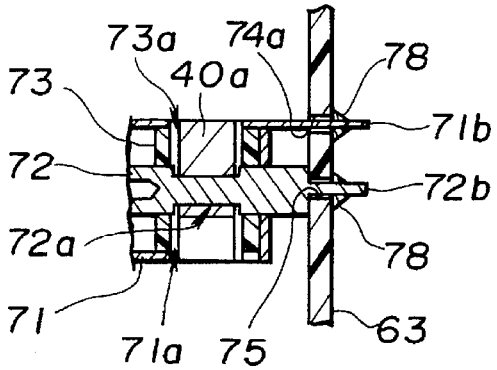
FIG. 11D illustrates the coaxial cable connector which has been connected to the printed circuit board.

Hence, the lug sections 71*b* and 72*b* on the proximal end of the connector 62 shown in FIG. 11A are inserted in the tunnels 74*a* and 75*a* of the printed circuit board 63 shown in FIG. 11B. As shown in FIG. 11D, the lug sections 71*b* and 72*b* sticking out on the backs of the tunnels 74*a* and 75*a* are respectively fixed to the printed circuit board 63 with solder 78, 78, thus accomplishing the electrical conduction between the cylindrical connector member 71 and the strip line 76*a* and between the rod-shaped connector member 72 and the strip line 77*a*.

Figure 13:
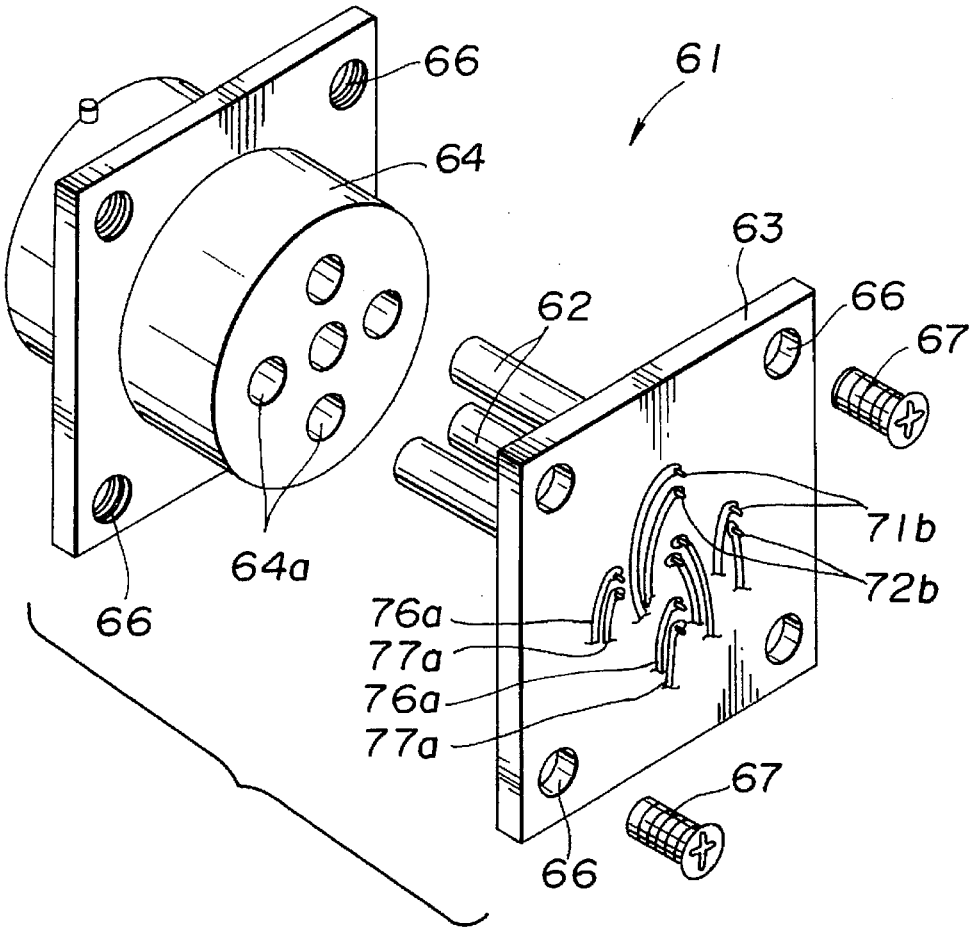

After attaching the plurality of connectors 62, 62, . . . to the printed circuit board 63 as shown in FIG. 13, the distal ends of the connectors 62, 62, . . . are inserted in the holes 64*a*, 64*a*, . . . of the shell 64, and the screws 67, 67, . . . are screwed in the mounting holes 66, 66, . . . , thereby connecting and fixing the printed circuit board 63 to the shell 64.

Figure 14:
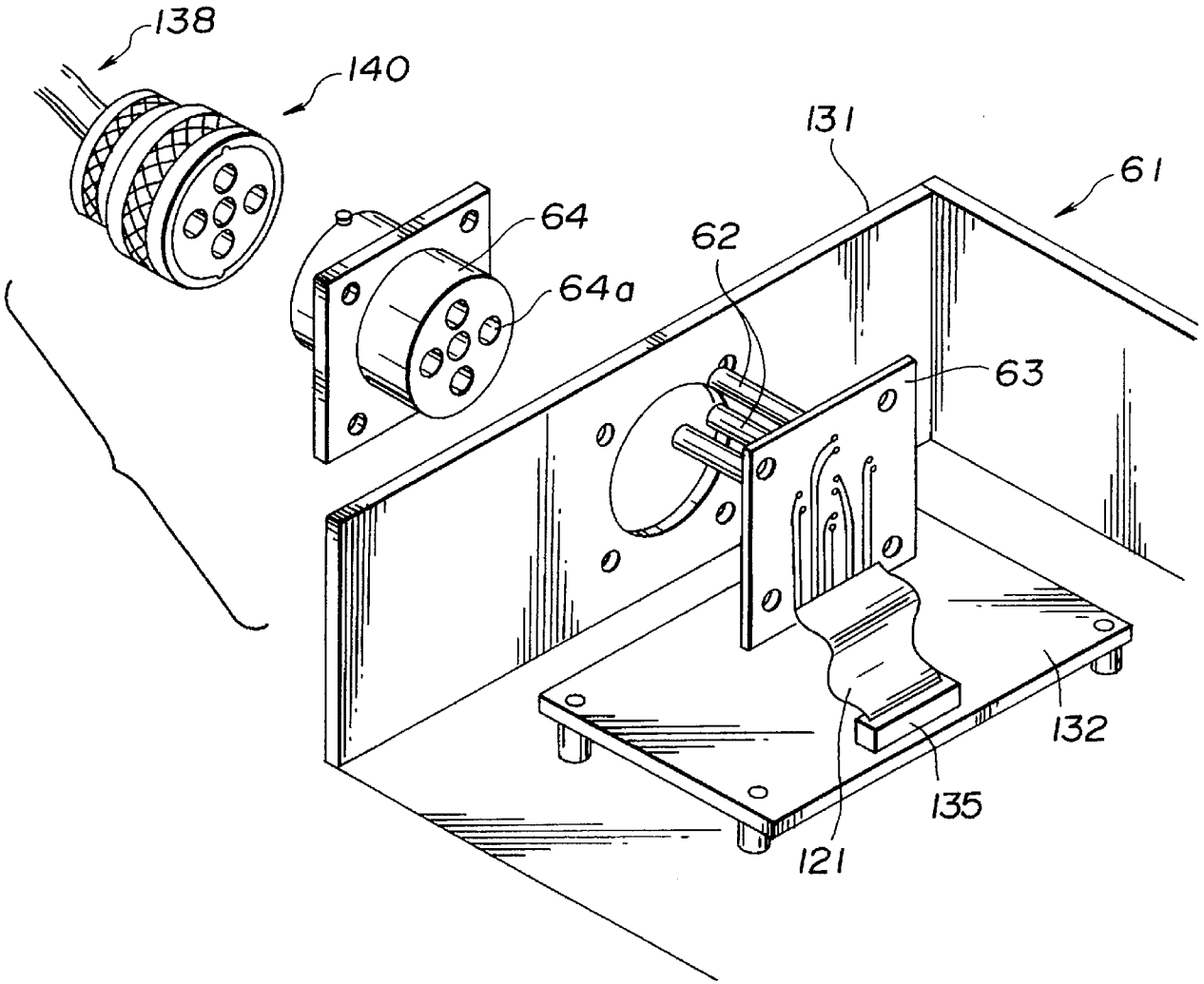

To connect cables to the coaxial connector apparatus 61, a plurality of coaxial lines may be connected or the flat cable 121 shown in FIG. 14 may be connected. FIG. 14 shows an example wherein the third embodiment is applied.

According to the third embodiment, the coaxial connector apparatus 61 can be fabricated simply by soldering the proximal end of the connector 62 to the printed circuit board 63. The soldering work is easy and therefore, the coaxial connector apparatus 61 can be completed easily and quickly, permitting reduced cost.

The conventional example does not permit the visual check for poor connection between the core and the rod-shaped connector member attached to the core. According to the present embodiment, the connection between the connector 62 and the printed circuit board 63 can be visually checked.

The third embodiment shown in FIG. 14 indicates the coaxial connector apparatus 61 on the connector receiving side; however, it can be reverse. To be more specific, the coaxial connector apparatus 61 of the third embodiment serves as the male connector to which a cable 138 shown in FIG. 14 is connected and a connector 140 of FIG. 14 is attached to the board via the cable. In the description above, the printed circuit board 63 to which the proximal end of the connector 62 is connected is provided with the through holes 74*a* and 75*a*; however, the through holes may be replaced by mere holes formed in the lands on the back surface. Reference numeral 132 denotes the board and reference numeral 135 denotes the connector for mounting on the board.

Figure 15A:
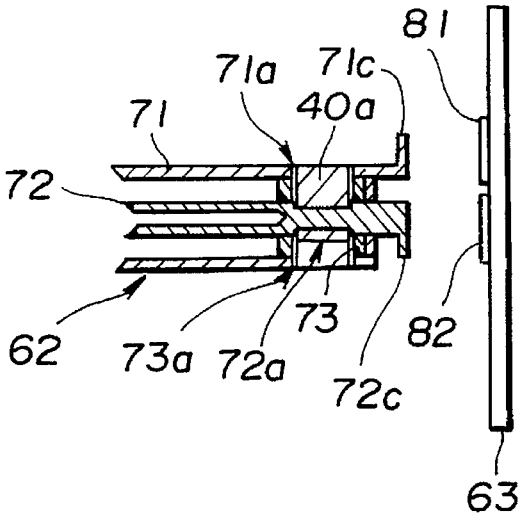
FIG. 15A is a diagram illustrating the structures of the coaxial cable connector and the printed circuit board according to a fourth embodiment of the present invention.

FIG. 15 shows the connector 62 and the printed circuit board 63 to which the connector 62 is connected and fixed in the fourth embodiment according to the present invention. For the purpose of simplicity, FIG. 15 shows an example wherein only one connector 62 is attached to the printed circuit board 63.

The connector 62 in the fourth embodiment has L-shaped sections 71*c* and 72*c*, which are bent nearly at right angles with respect to the length, in place of the lug sections 71*b* and 72*b* shown in FIG. 12 on the proximal ends of the cylindrical connector member 71 and the rod-shaped connector member 72.

Figure 15B:
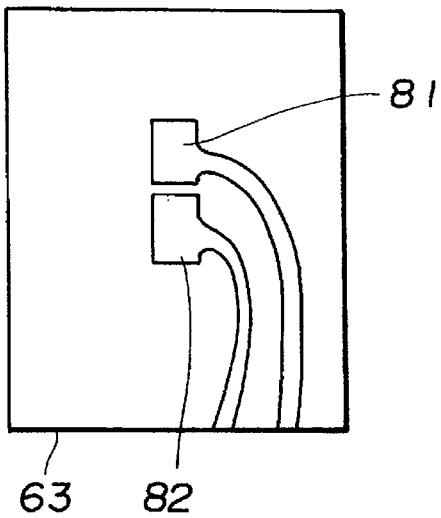
FIG. 15B is a front view of the printed circuit board of FIG. 15A.

Accordingly, the printed circuit board 63 has lands 81 and 82, with which the distal ends of the L-shaped sections 71*c* and 72*c* contact, the lands 81 and 82 being provided on the surface facing against the L-shaped sections 71*c* and 72*c*, instead of the tunnels 74*a* and 75*a*. The lands 81 and 82 are rectangular, for example, as shown in FIG. 15B and they are printed patterns. The coaxial lines or the like are attached to the ends of the printed patterns.

According to the fourth embodiment, the printed patterns provide the connection with the connector 62. Other operations and advantages are the same as those of the third embodiment.

Figure 16:
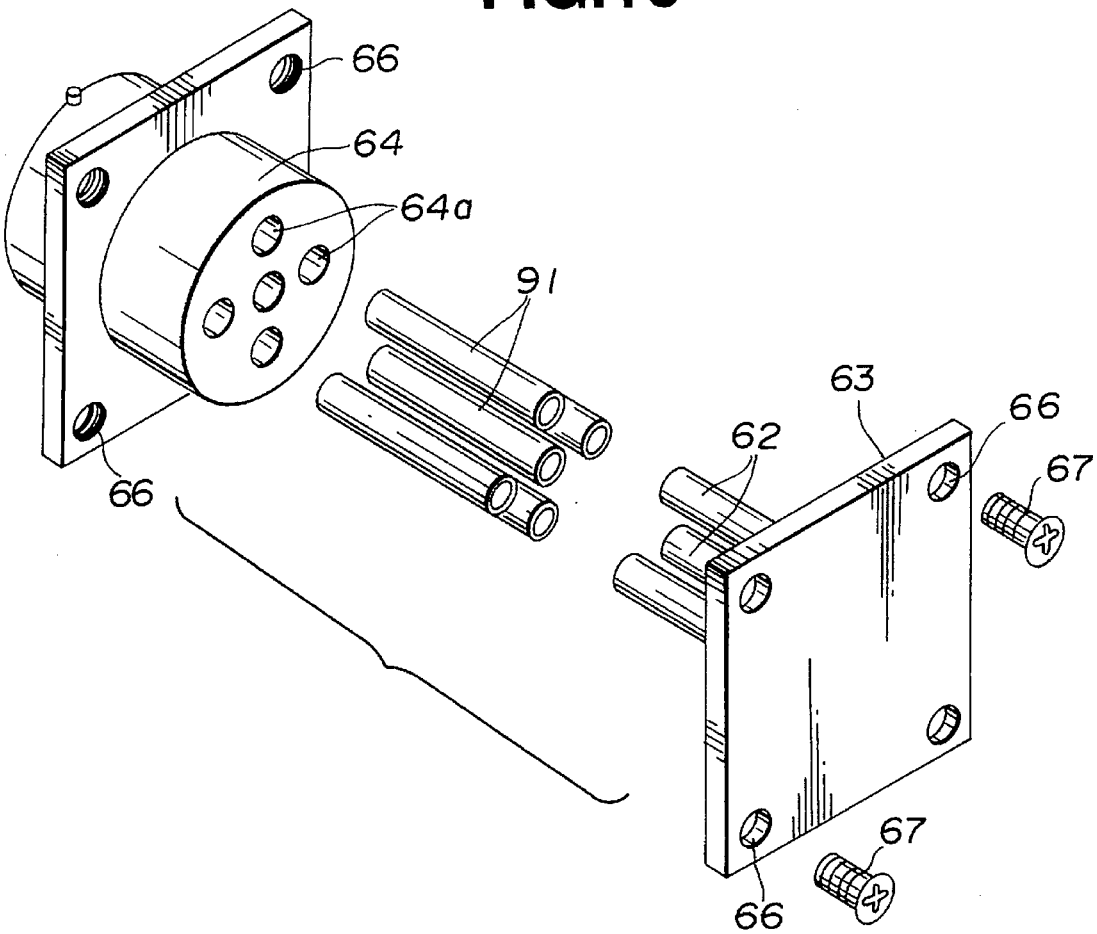
Figure 17A:
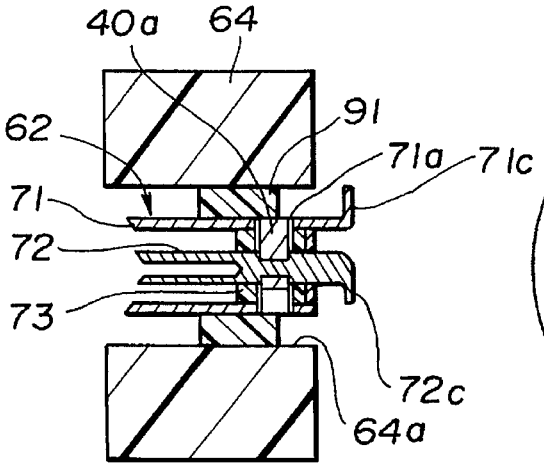
FIG. 17A is a cross-sectional view illustrative of the coaxial cable connector and a shell.
Figure 17B:
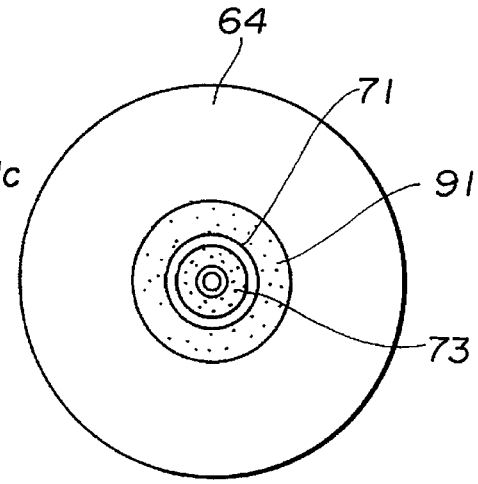
FIG. 17B is the front view of FIG. 17A.

FIG. 16 is the exploded view of the fifth embodiment of the present invention. This embodiment shows the waterproof connection between the shell 64 and the connector 62. To accomplish the waterproof structure, insulating tubes 91 are provided between the respective 64*a* of the shell 64 and the connectors 62 which are housed in the holes 64*a*. FIG. 17A is the simplified cross-sectional view of the shell 64; and FIG. 17B shows the front view. For the purpose of simplicity, the drawings show a case wherein only one connecting connector 62 is attached to the shell 64.

In the third embodiment or the fourth embodiment, to house the connector 62 in the hole 64*a* of the shell 64, a polymeric compound with extremely low permeability is employed for the insulator 73 which is shaped to fill the gap between the cylindrical connector member 71 and the rod-shaped connector member 72 so as to bring the insulator 73 in close contact with the connector members 71 and 72, thereby providing the waterproof structure.

In this embodiment, to house the connectors 62 shown in FIG. 15 in the holes 64*a* of the shell 64, the insulating tubes 91 are provided to achieve the waterproof structure between the shell 64 and the cylindrical connector member 71. To be more specific, as illustrated in FIG. 17, the insulating tube 91 is provided to completely fill the gap between the hole 64*a* of the shell 64 and the cylindrical connector member 71. A thermoplastic polymeric compound having low permeability is used for the insulating tube 91, so that it can be solidified by applying heat to it after assembly to provide the waterproof structure between the shell 64 and the cylindrical connector member 71. This embodiment exhibits the waterproof structure in addition to the same operations and advantages as those of the fifth embodiment described above.

Figure 18:
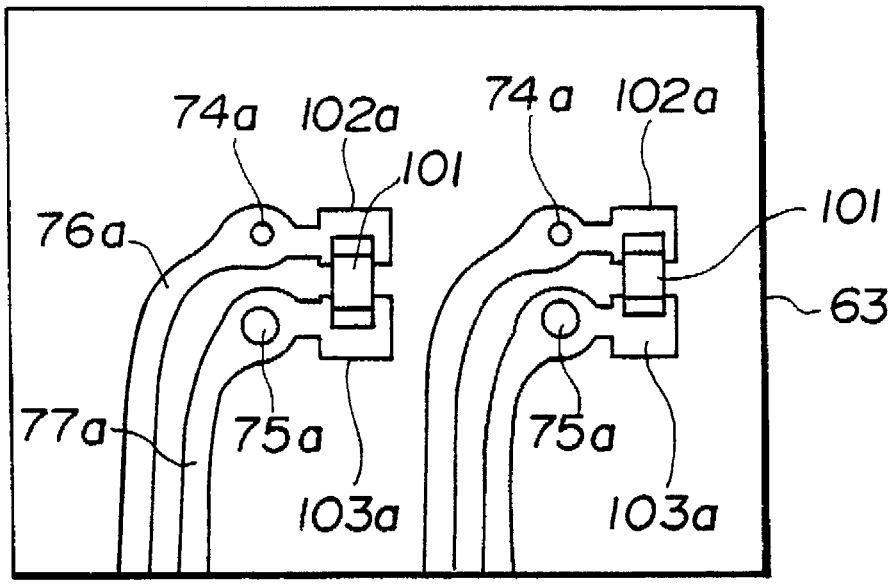
FIG. 18 is a diagram illustrating the structure of the printed circuit board according to a sixth embodiment of the present invention.

FIG. 18 shows the printed circuit board 63 in the sixth embodiment of the present invention. In this embodiment, antistatic diodes 101 are attached to the connections of the respective connectors 62. For the purpose of simplicity, FIG. 18 shows a case wherein two connectors 62 are attached to the printed circuit board 63. For instance, the tunnels 74*a* and 75*a* shown in FIG. 11C are pattern-connected to lands 102*a* and 103*a* for surface-mounting the diode 101, and the diode 101 is connected to the lands 102*a* and 103*a* with solder. Other tunnels 74*a* and 75*a* share the same structure.

The surface mounting is employed in this embodiment; however, tunnels or the like may alternatively be formed in the printed circuit board to mount the diode with lead wires. As another alternative, the connection may be made via lead wires with soldering from the vicinity of the mounting tunnels 74*a* and 75*a* to the electrodes of the diode rather than fixing the diode.

The present embodiment provides the following advantages in addition to those presented by the fifth embodiment.

As it is widely known, when handling a removable connector, a connector pin is very likely to be touched by a bare hand and the static electricity charged in the human body may flow back into the electric circuit through the connector, destroying the circuit. To avoid this problem, a protective diode is installed between the grounding potential side and the signal potential of the coaxial line. In this embodiment, a protective diode is added to prevent such electrostatic damage.

In the descriptions of the embodiments described above, the coaxial line of the coaxial cable or the flat cable is connected to the ends or the like of the strip lines of the printed circuit board; however, the present invention is not limited thereto. For example, it is also possible to provide the printed circuit board with a signal processing function. The ends of the strip lines on the printed circuit board 63 shown in FIG. 14 are connected to the board 132 via the flat cable 121. The circuit which is mounted on the board 132 and which is not shown may alternatively be provided, for example, on the back of the printed circuit board 63. This reduces the number of the flat cables for connecting the printed circuit board 63 and the board 132 shown in FIG. 14 or even eliminates the need of the flat cables.

The need of connecting the coaxial line to the printed circuit board can be eliminated by attaching a connector for input signals and output signals to a common printed circuit board to accomplish conduction via an electronic circuit mounted on the printed circuit board.

The board to which the proximal end of the connector is attached is not limited to a rigid board made of glass epoxy or the like; it may alternatively be a flexible board.

The embodiments discussed above refer to the coaxial cable connectors as the examples; however, it is obvious that the present invention is applicable also to an electric wire connector for connection and disconnection of a regular electric wire without departing from the concept thereof. Any assembly which employs a part or the like of any of the embodiments belongs to the present invention.

As many apparently widely different embodiments of the present invention can be made without departing from the spirit and scope thereof, it is to be understood that the invention is not limited to the specific embodiments thereof except as defined in the appended claims.

What is claimed is:

1. A coaxial cable connector comprising:

an insulating member having a cylindrical main body portion with an annular cross-section, an outer peripheral wall and an inner peripheral wall, wherein said inner peripheral wall defines a tunnel through a central axis of said insulating member and said outer peripheral wall has a cutout therein, said cutout having a rectangular surface including a flat section and an open section, a periphery of said open section coinciding with an outer circumference of an aperture provided between said open section of said cutout and said tunnel in a direction transverse to said central axis of said tunnel, said aperture also having an inner circumference where said aperture and said tunnel intersect;

a lengthy inner conductor which is inserted in said tunnel so that an electrical contact section protrudes out of an end of said tunnel and which has a fitting structure that comes to rest in a position adjacent said inner circumference of said aperture;

an outer conductor which is disposed around said insulating member and which has first and second outer windows through which said outer and inner circumference of said aperture are exposed: and a position restricting member made of an insulating material, said position restricting member being inserted through said open section of said cutout and said outer circumference of said aperature to mate with said fitting structure of said inner conductor to restrict said electrical contact section from further sliding movement.

2. The coaxial cable connector according to claim 1, wherein said fitting structure is a groove provided in an outer wall of said inner conductor and said position restricting member has a convex section which fits in said groove.

3. The coaxial cable connector according to claim 1, wherein said fitting structure is a groove provided fully around an outer circumferential surface around a lengthwise axis of said inner conductor and said position restricting member is horseshoe-shaped in cross-section with two forked sections to be fitted around said groove.

4. The coaxial cable connector according to claim 1, wherein said position restricting member has a projected section which closes said outer circumference of said aperture.

5. The coaxial cable connector according to claim 1, further comprising an outer conductor which is disposed around said insulating member and which has first and second outer windows through which said outer and inner circumference of said aperature exposed, and a covering member which covers said first outer window of said outer conductor.

6. The coaxial cable connector according to any one of claim 1 and claim 5, wherein said position restricting member has a shoulder which closes said outer and inner circumference of said aperture.

7. The coaxial cable connector according to any one of claim 5 and claim 6, wherein said position restricting member has a shoulder which fits in said first or second outer window of said outer conductor.

8. A coaxial cable connector comprising:

an insulating member having a cylindrical main body portion with an annular cross-section, an outer peripheral wall and an inner peripheral wall, wherein said inner peripheral wall defines a tunnel through a central axis of said insulating member and said outer peripheral wall has a cutout therein, said cutout having a rectangular surface including a flat section and an open section, said open section being an outer circumference of an aperture provided between said open section of said cutout and said tunnel in a direction transverse to said central axis of said tunnel, said aperture also having an inner circumference where said aperture and said tunnel intersect;

a lengthy inner conductor which is inserted in said tunnel so that an electrical contact section protrudes out of said tunnel and which has a fitting structure that comes to rest in a position adjacent an inner circumference of said aperture;

a position restricting member made of an insulating material, said position restricting member being inserted through said open section of said cutout an said outer circumference of said aperture to mate with said fitting structure of said inner conductor to restrict said electrical contact section from further sliding movement;

an outer conductor which is disposed around said insulating member, which has first and second outer windows through which said outer and inner circumference of said aperture are exposed, and which has a projected section on one end thereof; and a plane board which is provided with an electrically conductive section, to which projected sections of said inner conductor and said outer conductor are connected and fixed, and which are approximately perpendicular to said inner conductor and said outer conductor.

9. A coaxial cable connector according to claim 1, wherein said position restricting member has a shoulder which fits in the window of said outer conductor.

10. A coaxial cable connector according to claim 6, wherein said position restricting member has a shoulder which fits in the first or second outer window of said outer conductor.

* * * * *